US012698598B2

(12) United States Patent
Olah et al.

(10) Patent No.: US 12,698,598 B2
(45) Date of Patent: Aug. 4, 2026

(54) EMBED FAÇADE ATTACHMENTS AND RELATED SYSTEMS AND METHODS

(71) Applicant: Simpson Strong-Tie Company Inc., Pleasanton, CA (US)

(72) Inventors: Timothy J. Olah, Independence, MO (US); Michael Bennett, Lees Summit, MO (US); Timothy Ellis, Thousand Oaks, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 887 days.

(21) Appl. No.: 17/948,027

(22) Filed: Sep. 19, 2022

(65) Prior Publication Data

US 2023/0087996 A1 Mar. 23, 2023

Related U.S. Application Data

(60) Provisional application No. 63/245,705, filed on Sep. 17, 2021.

(51) Int. Cl.
*E01B 9/30* (2006.01)

(52) U.S. Cl.
CPC ..... *E01B 9/306* (2013.01)

(58) Field of Classification Search
CPC ..... E04F 13/0835; E04B 1/4107; E01B 9/306
See application file for complete search history.

(56) References Cited

U.S. PATENT DOCUMENTS 2,375,513 A * 5/1945 Bach ..... F16L 3/24 248/62
7,624,556 B2 * 12/2009 Plooksawasdi ..... E04C 5/125 52/855
9,683,367 B1 * 6/2017 Ting ..... E04B 1/41
11,680,400 B2 * 6/2023 Espinosa ..... E04B 1/4107 52/295
2007/0039258 A1 * 2/2007 Walker, III ..... E04B 2/96 52/235
2010/0257812 A1 * 10/2010 Schultz ..... E04B 2/96 52/704
2014/0250825 A1 * 9/2014 Richardson ..... F16B 7/187 411/81
2023/0087996 A1 * 3/2023 Olah ..... E01B 9/306 238/338

FOREIGN PATENT DOCUMENTS

CN 110777947 A * 2/2020 ..... E04B 1/4107
EP 2596182 B1 * 10/2014 ..... E04B 1/4107
NL 2033816 B1 * 7/2024 ..... F24S 20/66
WO WO-2021007653 A1 * 1/2021 ..... E04B 2/90

* cited by examiner

*Primary Examiner* — Jason C Smith

(74) *Attorney, Agent, or Firm* — Pearl Cohen LLP

(57) ABSTRACT

An embed façade attachment system comprises an inner channel and an outer channel. The inner channel is configured to receive one or more fasteners between an upper retaining flange and a lower retaining flange. The outer channel is defined between an upper outward flange and a lower outward flange and configured to receive one or more fasteners. One of the inner channel and the outer channel is coupled to a concrete reinforcement element and another of the inner channel and the outer channel is removably coupled to a façade element by the one or more fasteners. The façade attachment is embedded in concrete with at least the inner channel or the outer channel exposed to a surface of the concrete to allow coupling of the façade element.

17 Claims, 12 Drawing Sheets

FIG. 11
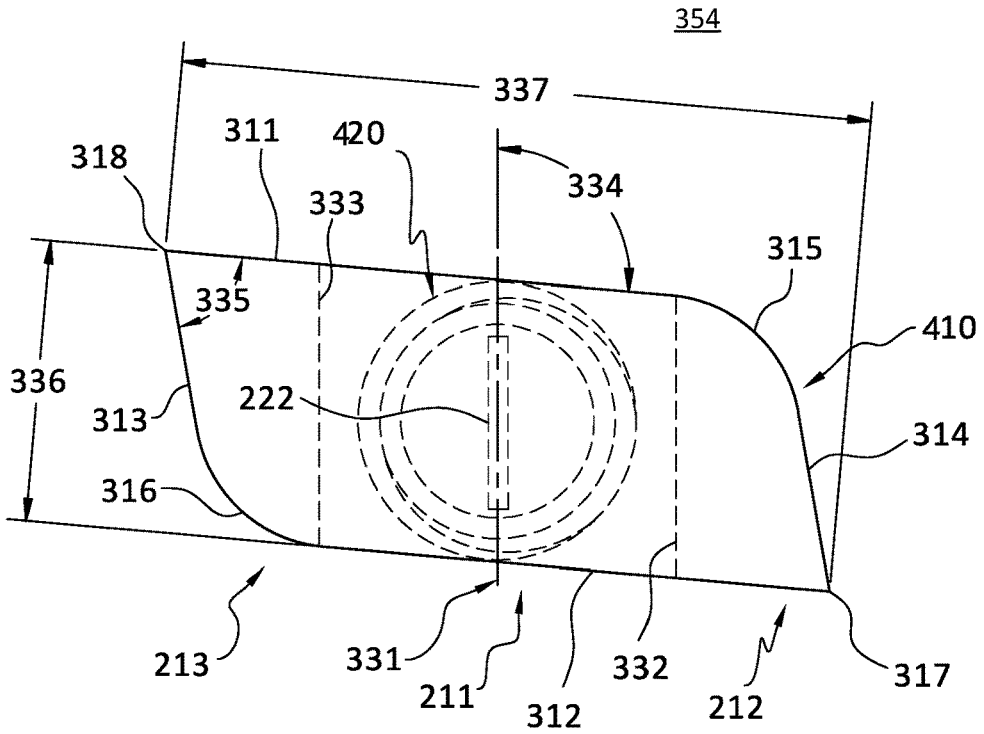
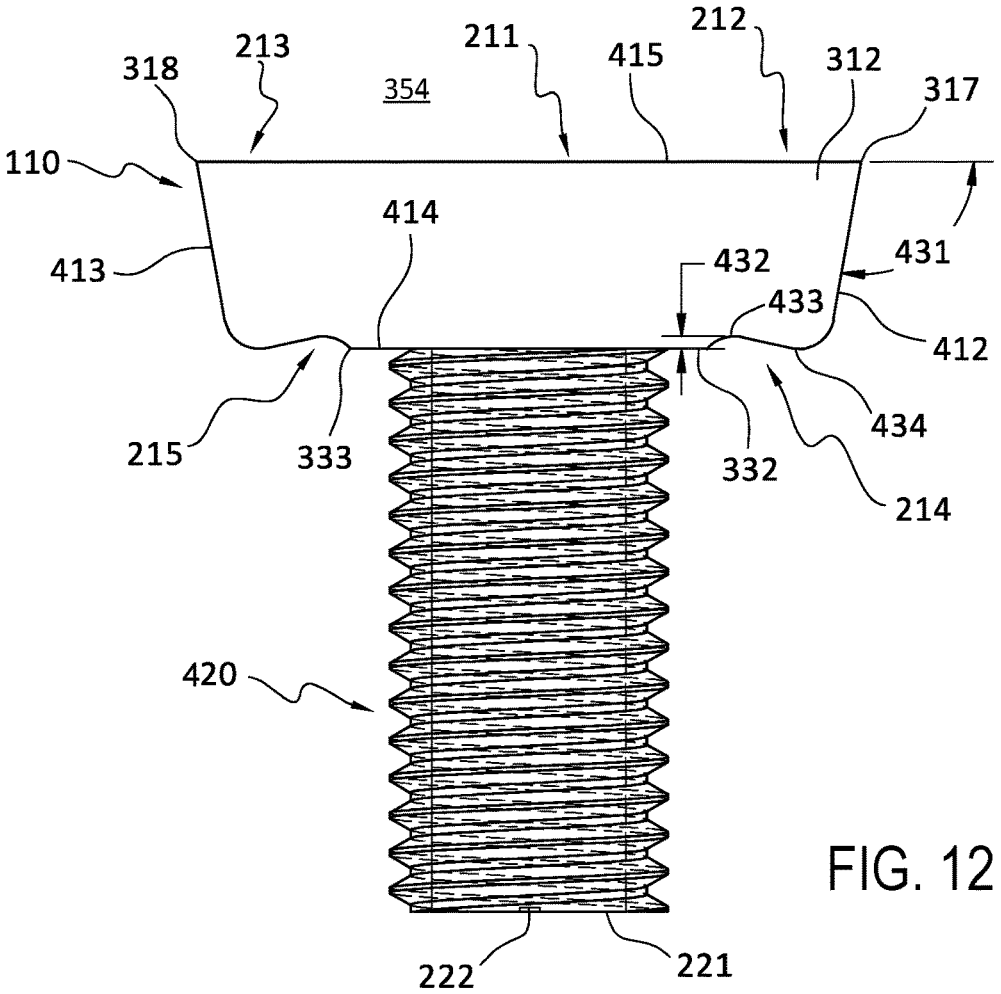
FIG. 12

EMBED FAÇADE ATTACHMENTS AND RELATED SYSTEMS AND METHODS

CLAIM OF PRIORITY

This application claims priority to U.S. Provisional Patent Application No. 63/245,705, entitled "EMBED FACADE ATTACHMENTS AND RELATED SYSTEMS AND METHODS", filed Sep. 17, 2021, which application is incorporated by reference herein in its entirety.

BACKGROUND

Building façades may comprise outer coverings on buildings which non-structural and to provide a barrier between the building interior and the outside of a building. For example, a curtain wall system is designed to mount adjacent panels, whether vertically adjacent or horizontally adjacent, side by side to cover and obscure structural beams and columns behind the façade and thereby provide a uniform and continuous surface.

Glass panels are a commonly used façade, but other materials include metal panels, stone veneer and composite material panels. In some systems, material forming the façade is hung from a bracket system mounted along an exterior edge of an upper floor slab so that façade appears to hang from the ceiling. In other systems, façade materials are mounted to be supported at their lower ends into window sills that are fixed by screws or otherwise to the outer edge of a floor or subwall.

SUMMARY

One general aspect includes an embed façade system including an inner channel (110) configured to receive one or more fasteners between an upper retaining flange (111) and a lower retaining flange (112). The embed façade system also includes an outer channel (120) defined between an upper outward flange (130), and a lower outward flange (140) and configured to receive one or more fasteners. The embed façade system also includes one of the inner channel and the outer channel coupled to a concrete reinforcement element. The embed façade system also includes another of the inner channel and the outer channel is removably coupled to a façade element by the one or more fasteners. The embed façade system also includes the façade attachment embedded in concrete with at least the inner channel or the outer channel exposed to a surface of the concrete to allow coupling of the façade element.

One general aspect includes a method for installing an embed façade attachment system in a reinforced concrete structure. The method also includes coupling an inner side of the embed façade attachment system to a reinforcing structure in the concrete structure; coupling a temporary concrete form to the embed façade attachment system at an outer side; pouring mixed concrete in the inner side of the concrete form to submerge the embed façade attachment system, except the outer channel; and removing the concrete form after the concrete is cured, to expose the outer channel of the embed façade attachment system.

One general aspect includes a method for installing an embed façade attachment system in a reinforced concrete structure. The method also includes coupling the embed façade attachment system at an outer side of the embed façade attachment system to a reinforcing structure laid out for the concrete structure; inserting a malleable concrete stop into an inner channel (110), pouring mixed concrete around the embed façade attachment system to submerge the embed façade attachment system, removing the concrete stop leaving the inner channel substantially free of concrete, inserting a fastener into the inner channel and securing a façade attachment plate using the fastener.

BRIEF DESCRIPTION OF DRAWINGS

Aspects of the present disclosure are illustrated by way of example and are not limited by the accompanying figures for which like references indicate the same or similar elements.

FIG. 11 illustrates a top plan view of the T-bolt of FIG. 9.

FIG. 12 illustrates a side elevation view of the T-bolt of FIG. 9.

DETAILED DESCRIPTION

Various embodiments include an embed façade attachment. The embed façade attachment can be configured to removably couple a façade panel to a concrete or frame construction structure, such as a concrete wall or floor. The embed façade attachment further can be configured to be embedded in, and flush with, an exterior vertical surface of the structure, or a horizontal surface of the structure. The embed façade attachment can be made of any suitable materials, such as carbon steel, and by any suitable approach, such as extrusion.

Figure 1:
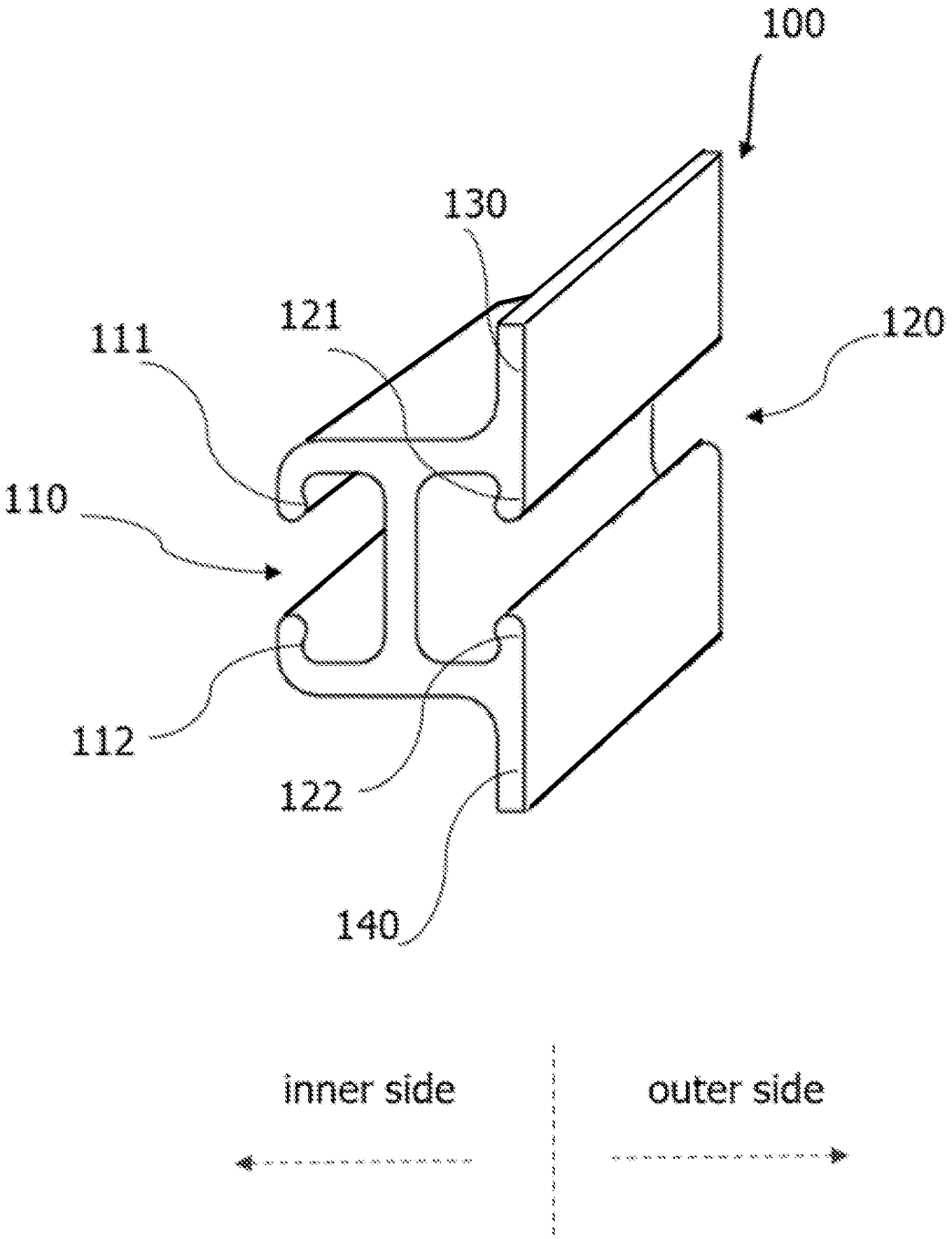
FIG. 1 is a perspective view of an embedded façade attachment.

FIG. 1 illustrates an exemplary embed façade attachment (100). Embed façade attachment (100) is merely exemplary, and embodiments of the embed façade attachment are not limited to the embodiments depicted and described herein. The embed façade attachment can be employed in many different embodiments or examples not specifically depicted or described herein. Attachment (100) includes an inner channel (110), an outer channel (120), an upper outward flange (130), and a lower outward flange (140). The opening of inner channel (110) is facing an inner side of attachment (100) while the opening of outer channel (120) is facing an outer side of attachment (100) opposing the inner side. Inner channel (110) can be configured to receive one or more inner fasteners (e.g., the head of a T-bolt) (not shown) so that the one or more inner fasteners can couple the attachment (100) to one or more wall enforcement structures (e.g., rebar). Outer channel (120) can be configured to receive one or more outer fasteners (e.g., the head of a T-bolt) (not shown)

so that the one or more outer fasteners can removably couple one or more façade panels to attachment (100). It will be recognized that the terms "inner" and "outer" are used relative to the embodiment of FIG. 1 as referring to the interior and exterior of a building, but are not limited thereto. In other embodiments, the "inner" portions referred to herein may be closer to the exterior surface of a building or building structure (and may form a façade connecting channel), while the "outer" portions are in fact closer to the interior of a building.

As shown in FIG. 1, inner channel (110) further includes an upper retaining flange (111) and a lower retaining flange (112). Upper retaining flange (111) and lower retaining flange (112) can be configured to retain the one or more inner fasteners in inner channel (110). Outer channel (120) further includes an upper retaining flange (121) and a lower retaining flange (122). Upper retaining flange (121) and lower retaining flange (122) can be configured to prevent the one or more outer fasteners received in outer channel (120) from falling out.

Continuing with FIG. 1, upper outward flange (130) is coupled to, while extending away from, upper retaining flange (121) of outer channel (120), and lower outward flange (140) is coupled to, while extending away from, lower retaining flange (122) of outer channel (120). Upper outward flange (130), upper retaining flange (121), lower outward flange (140), and/or lower retaining flange (122) can be substantially coplanar on the outer side.

Figure 2A:
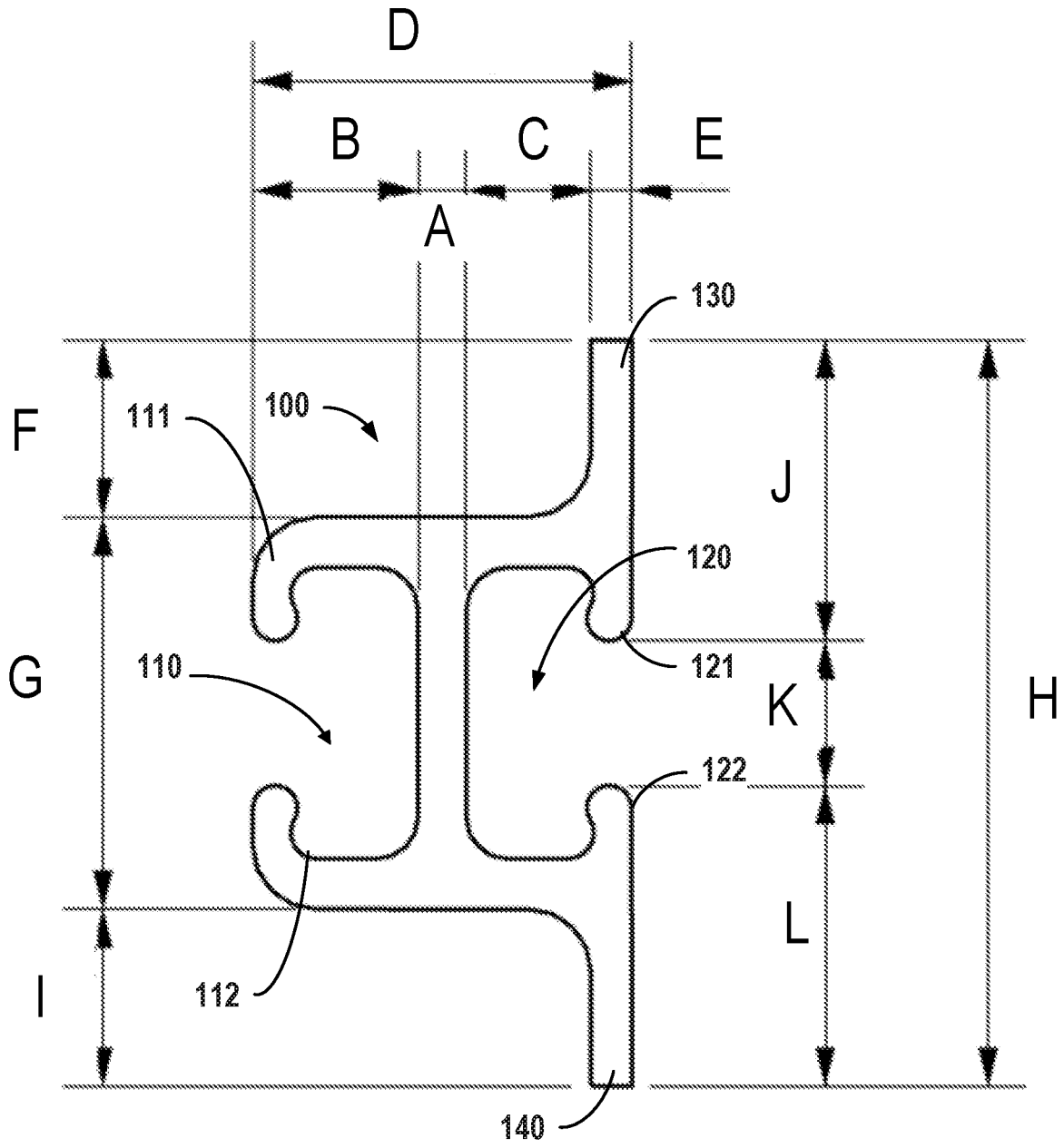
FIG. 2A is an end view of an embed façade attachment.
Figure 2B:
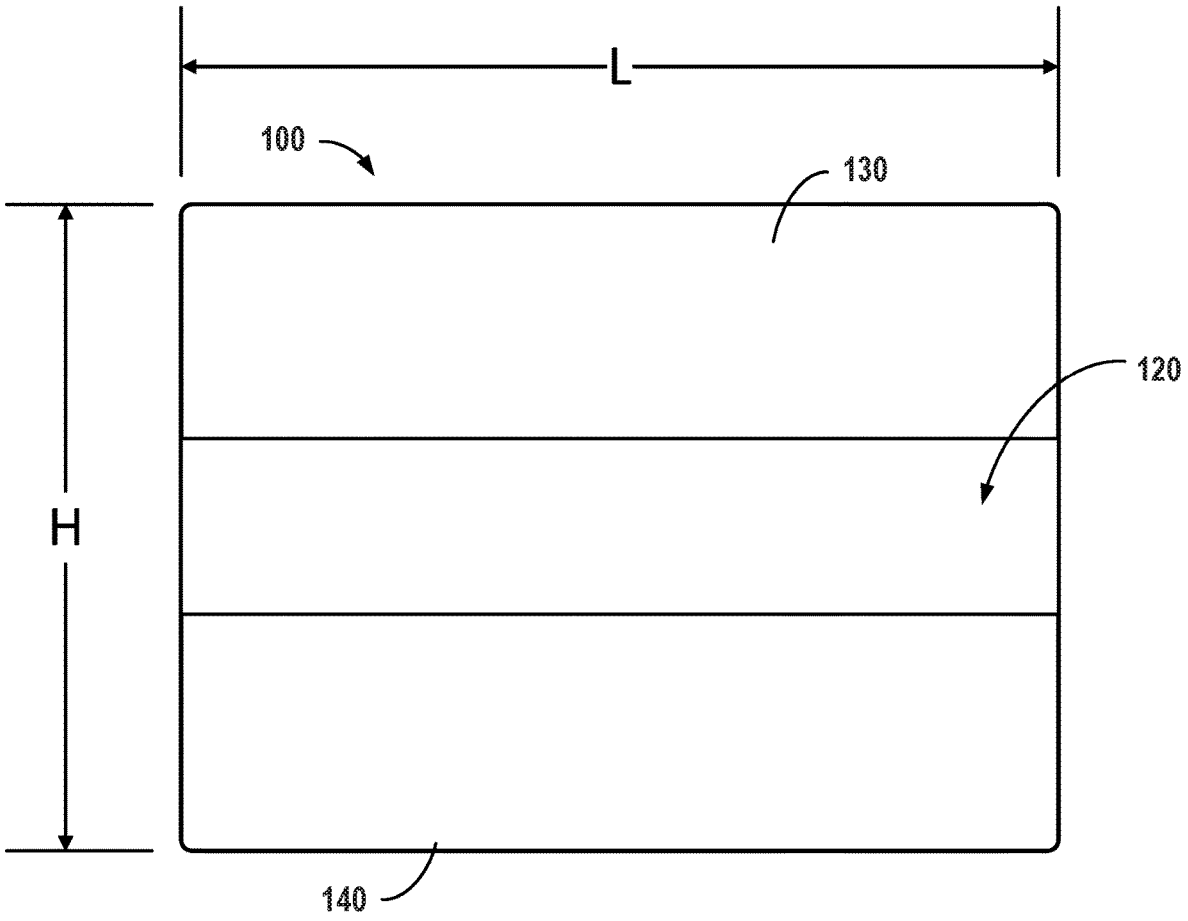
FIG. 2B is a plan view of an embed façade attachment.

FIG. 2A illustrates a cross section or end view of embed façade attachment (100), and FIG. 2B illustrates a top view of the embed façade attachment (100). FIGS. 2A and 2B further shows various dimensions (approximately) of attachment (100) in inches (or feet, as indicated). In this or other embodiment, attachment (100) can be extruded from round steel billets into an integral item. In some embodiments, attachment (100) can have a yield strength of at least 80 ksi (kilo-pound-force per square inch). In one embodiment, the dimensions are those as listed in Table 1:

| | |
|---|---|
| A | 5/16" |
| B | 1" |
| C | 3/4" |
| D | 2 5/16" |
| E | 1/4" |
| F | 1 1/16" |
| G | 2 3/8" |
| H | 4 1/2" |
| I | 1 1/16" |
| J | 1 13/16" |
| K | 7/8" |
| M | 1 13/16" |
| L | 4 1/2" - - 30 ft. |

Figure 3:
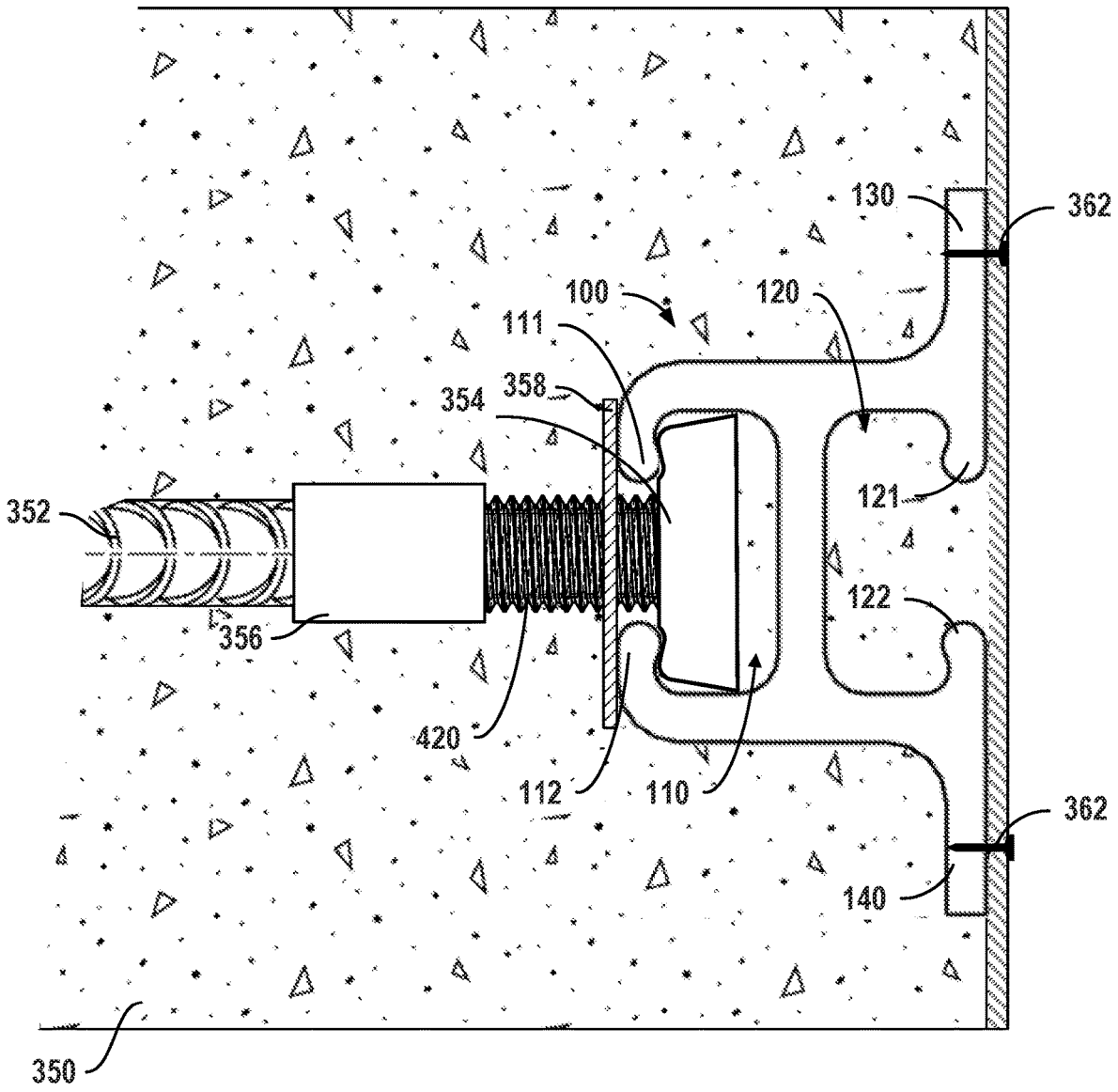
FIG. 3 is an end view of an embed façade attachment in a concrete slab.

FIG. 3 illustrates a cross sectional view of a building portion 300, showing exemplary embed façade attachment (100) embedded in a concrete wall (350) and coupled to a piece of rebar (352) while the concrete of concrete wall (350) is being cured. In other embodiments, embed façade attachment (100) can be installed in concrete floor slabs or other poured concrete structures. In some embodiments, there can be a single embed façade attachment (100) installed in the concrete, which can be short or long, as noted above. In some other embodiments, there can be a multiple pieces of embed façade attachment (100) installed in the concrete, such as in a row or in various different positions. In assembled embodiments, multiple embed façade attachments (100) of a shorter length (e.g. 4.5") are used along the length of a side or floor of a building or building structure. In other embodiments, longer lengths (e.g. 30 ft. or longer) may be used along the length of a side or floor of a building structure.

As shown in FIG. 3, inner channel (110) can be coupled to the piece of rebar (352) via a T-bolt (354) partly received in inner channel (110) and a coupler (356) coupling a shank (420) of T-bolt (354) and an end of the piece of rebar (352). The head of T-bolt (354) can be received in inner channel (110) and locked by an upper retaining flange (111) and a lower retaining flange (112) of inner channel (110). The end of rebar (352), the shank of T-bolt (354), and coupler (356) can be threaded to be coupled together. Further, a temporary concrete form (360) can be coupled to attachment (100) at the outer side by nails (e.g., 362) affixed to an upper outward flange (130) and/or a lower outward flange (140) of attachment (100). The temporary concrete form can be plywood or another suitable material. The nails (e.g., 362) also can be embedded in temporary concrete form (360).

Various embodiments can include a method for installing embed façade attachment system (100) in a reinforced concrete or frame construction structure (e.g., concrete wall (350)) (or other poured concrete structures, such as a concrete floor slab). The method can include: (a) coupling the embed façade attachment system at the inner side of the embed façade attachment system to a reinforcing structure (e.g. the threaded rebar (352)) laid out for the concrete structure, such that an inner channel (e.g., 110) and an outer channel (e.g. 120) of the embed façade attachment system both open substantially horizontally; (b) coupling a temporary concrete form (e.g., 360) to the embed façade attachment system at the outer side, which in some embodiments, can results in an opening of the outer channel (e.g., 120) being fully covered by the concrete form (e.g., 360); (c) pouring mixed concrete in the inner side of the concrete form (e.g., 360) to submerge the embed façade attachment system, except the outer channel (e.g., 120); and/or (d) removing the concrete form (e.g., 360), after the concrete is cured, to expose the outer channel of the embed façade attachment system.

In many embodiments, once installed, the embed façade attachment system (e.g., 100), including the upper outward flange (130), upper retaining flange (121), lower outward flange (140), and/or lower retaining flange (122) that are substantially coplanar on the outer side, can become flush with the exterior surface of the concrete structure. In some embodiments, items (a)-(d) of the method can be performed in any suitable orders, and one or more items can be omitted or altered. In the aforementioned embodiment, the embed façade attachment the outer channel is exposed to the exterior to allow horizontal coupling of the façade element.

In a number of embodiments, coupling the embed façade attachment system at the inner side to the reinforcing structure can include inserting a respective expanded end of each of one or more inner fasteners (e.g., the head of a T-bolt (e.g., T-bolt (354)) into the inner channel (e.g., 110) of the embed façade attachment system and allowing a respective other end of the each of the one or more inner fasteners (e.g., the threaded shank of the T-bolt (354)) to pass through and protruding from an opening of the inner channel (e.g., 110). The method also can include locking each of the one or more inner fasteners by the respective expanded end of the fastener engaging with an upper retaining flange (e.g., 111) and a lower retaining flange (e.g., 112) of the inner channel (e.g., 110) at a respective location for the each of the one or more inner fasteners. The respective location for each of the one or more inner fasteners can be evenly distributed along the length of inner channel (e.g., 110). In some embodiments, the embed façade attachment system further can include the one or more inner fasteners pre-installed in the inner channel (e.g., 110), and inserting and/or locking the one or more inner fasteners can be omitted from the method of installing the embed façade attachment system.

In some embodiments, coupling the embed façade attachment system at the inner side to the reinforcing structure further can include, after the one or more inner fasteners are inserted and/or locked in the inner channel (e.g., 110), using a coupler (e.g., 356) to couple the each of the one or more inner fasteners at the respective protruding end to an end of the reinforcing structure (e.g., rebar (352)). In some embodiments, the respective protruding end of each of the one or more inner fasteners and the end of the reinforcing structure can be externally threaded and configured to be engaged with coupler (356), which can be an internally threaded cylinder. In some embodiments when an end of the reinforcing structure and an inner fasteners have different outer radiuses, coupler (356) can have different corresponding inner radiuses at the opposing ends. In several embodiments, a washer (358) can be put on each of the one or more inner fasteners, between coupler (356) and the upper retaining flange (e.g., 111) and the lower retaining flange (e.g., 112) of the inner channel (e.g., 110). In embodiments where the one or more inner fasteners are pre-installed in the inner channel (e.g., 110) of an embed façade attachment system, coupler (356) and/or washer (358) further can be provided on each of the pre-installed one or more inner fasteners.

In some embodiments, coupling the temporary concrete form (e.g., 360) to the embed façade attachment system (e.g., 100) at the outer side can include nailing the temporary concrete form (e.g., 360) to the upper retaining flange (e.g., 121) and/or the lower retaining flange (e.g., 122) of the inner channel (e.g., 110). In certain embodiments, the temporary concrete form (e.g., 360) can be provided with embedded nails (e.g., 362).

Various embodiments can include a method for removably coupling a façade panel (not shown) on an embed façade attachment system (e.g., attachment (100) (FIGS. 1-3)) installed in a reinforced concrete or frame construction structure (e.g., the concrete wall (350) (FIG. 3)). The method can include inserting a respective expanded end of each outer fastener of one or more outer fasteners (e.g., the head of a T-bolt (e.g., which can be similar or identical to T-bolt (354)) into the outer channel (e.g., 120) of the embed façade attachment system and allowing a respective other end of the each of the one or more outer fasteners (e.g., the threaded shank of the T-bolt) to pass through and protrude from an opening of the outer channel (e.g., 120).

In a number of embodiments, the method further can include locking the each outer fastener by the respective expanded end of the each outer fastener engaging with an upper retaining flange (e.g., 121) and a lower retaining flange (e.g., 122) of the outer channel (e.g., 120) at a respective location for the each outer fastener. The method additionally can include using a coupler (e.g., 356) to removably couple the outer fastener at the respective protruding end to an attachment component of the façade panel. The coupler for removably coupling the outer fastener can be similar to or different from the coupler for coupling each of the one or more inner fastener. In a number of embodiments, the respective location for each of the one or more outer fasteners can be evenly distributed along the length of the outer channels (e.g., 120) or the façade panel. In some embodiments, the façade panel can be a post-sleeve for a railing system, a shear connection for a curtain wall, or another suitable type of connection to be attached to the outside of building portion (concrete wall) 300. In some embodiments, the aforementioned acts of the method can be performed in any suitable orders, and one or more acts can be omitted or altered.

Figures 4A, 4B:
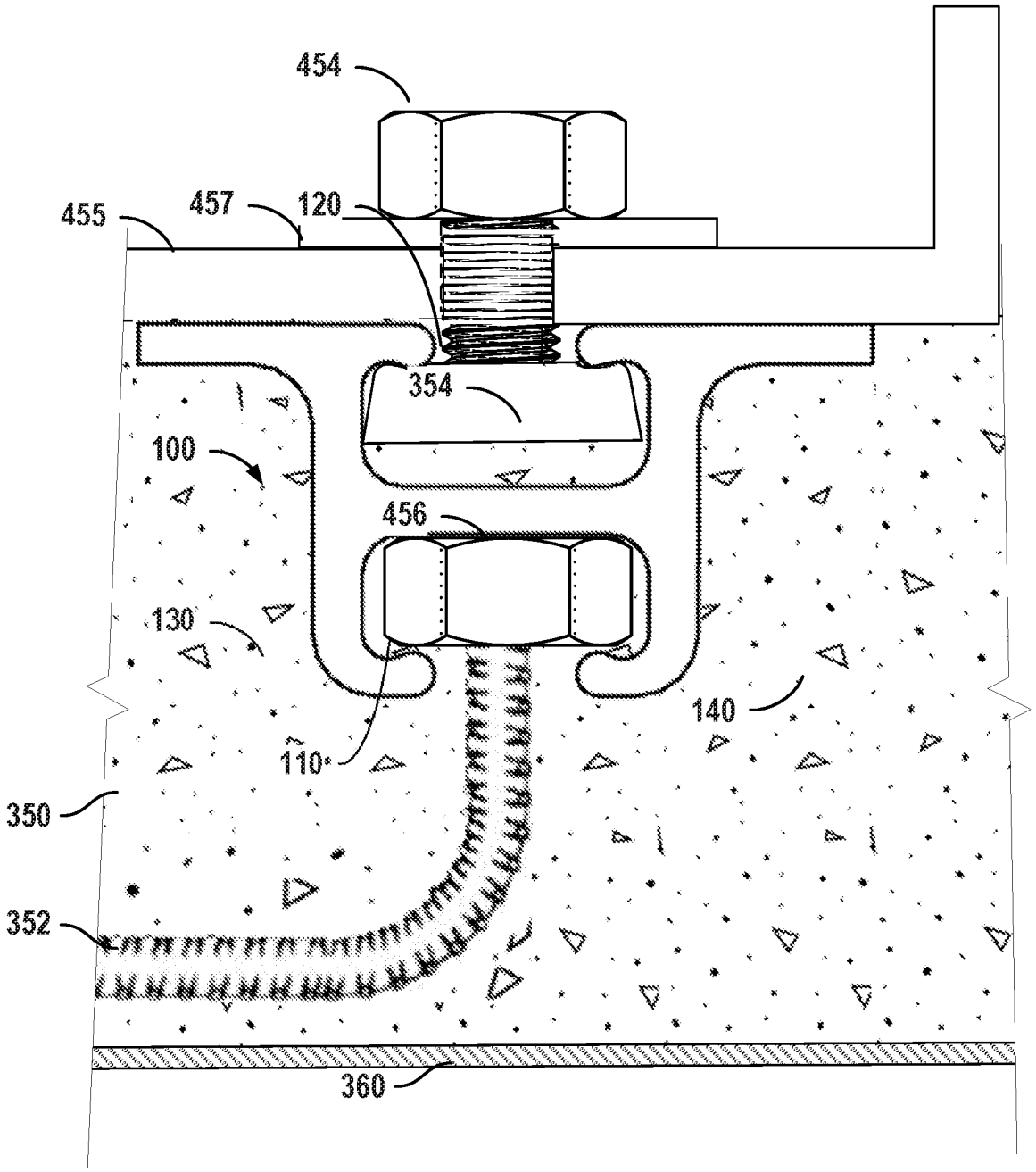
FIG. 4A is an end view of a second embed façade attachment in a concrete slab.
Figure 4B:
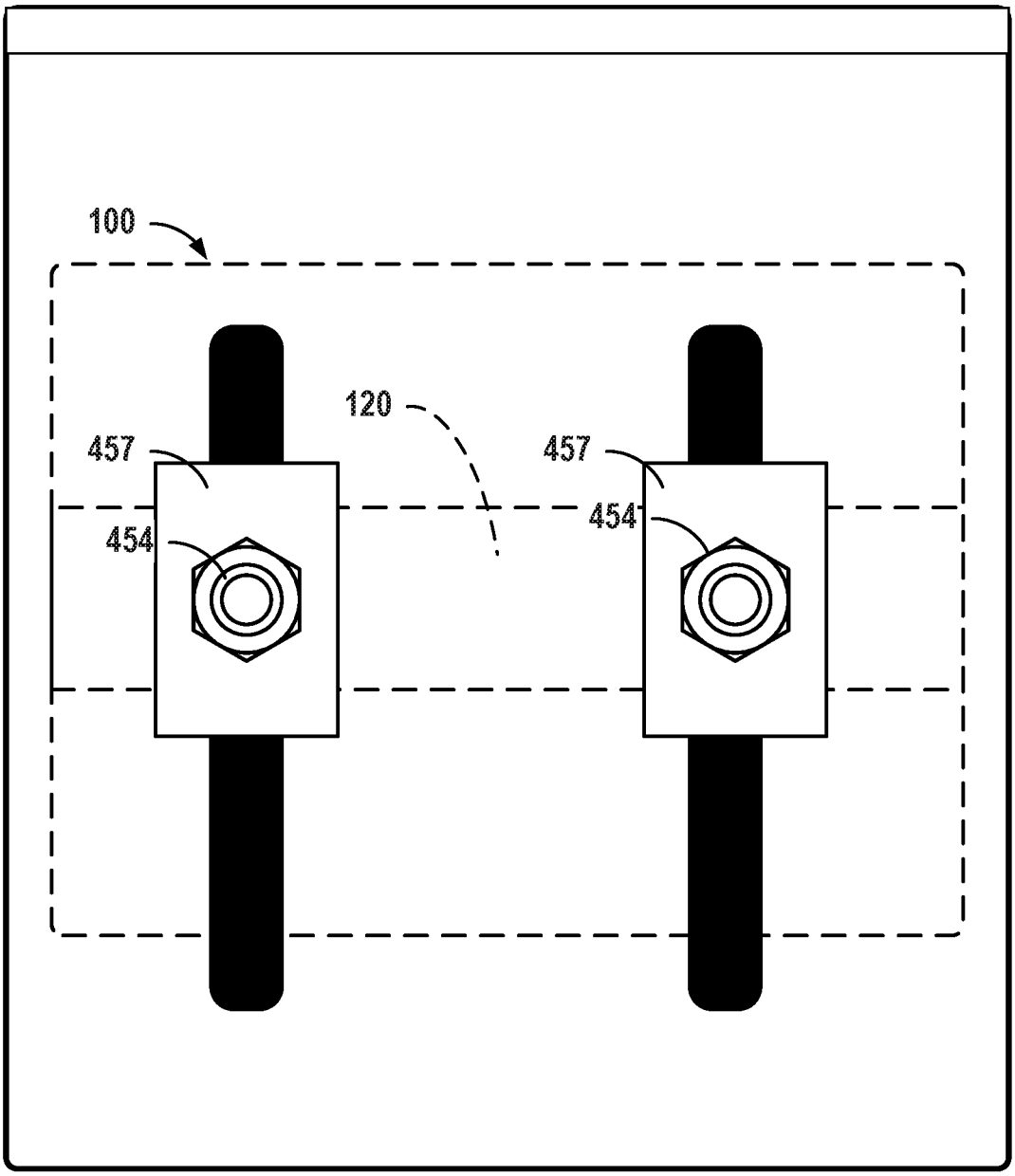
FIG. 4 B is a top view of the second embed façade attachment in a concrete slab.

FIG. 4A illustrates a cross sectional view of a building portion 300, showing exemplary embed façade attachment (100) embedded in a concrete floor (350) and coupled to a piece of rebar (352) and a slotted bracket while the concrete of concrete wall (350) is being cured. FIG. 4B is a top view of the embodiment of FIG. 4A along lines 4B in FIG. 4A. Slotted bracket (457) may comprise a bracket for mounting a building façade thereon and include a lip (457*a*). The particular configuration of the slotted bracket may be specified by façade manufacturers and may take many different forms, some of which are specific to the manufacturer's façade elements. As shown in FIG. 4A, inner channel (110) can be coupled to the piece of rebar (352) via a nut (456). Rebar 352 is part of the framing of the flooring of a building. A T-bolt (354) partly received in outer channel (120) and secures a slotted plate (455) using a nut (454). Other types of fasteners may be used in place of T-bolt (354) The head of T-bolt (354) can be received in outer channel (120) and locked by an upper retaining flange (121) and a lower retaining flange (122) of outer channel (120). Further, a temporary concrete form (360) of plywood or another suitable material serves as a base for a cast in place concrete floor (350).

Figure 5:
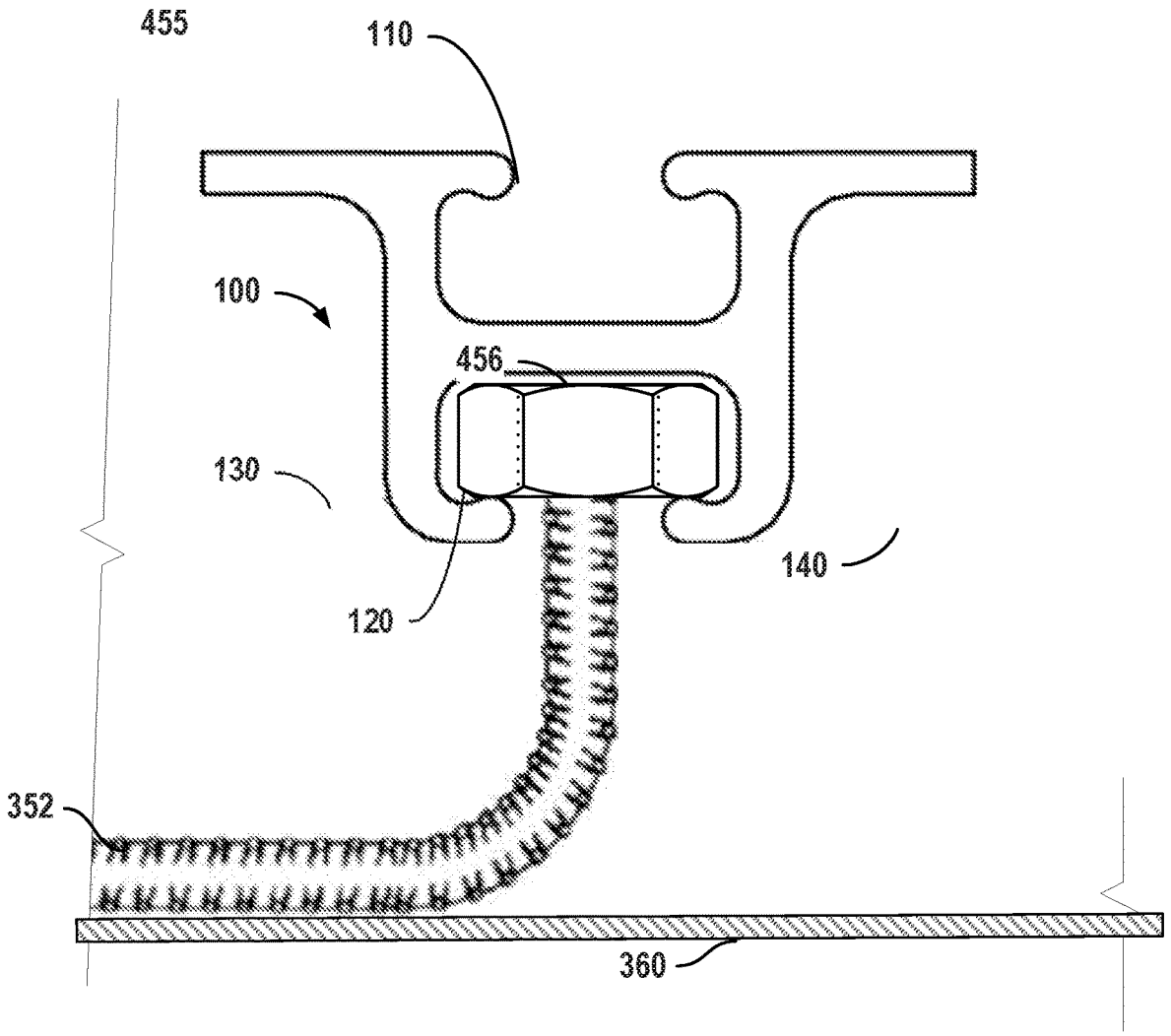
FIG. 5 is an end view of a rotated embed façade attachment connected to rebar.
Figure 6:
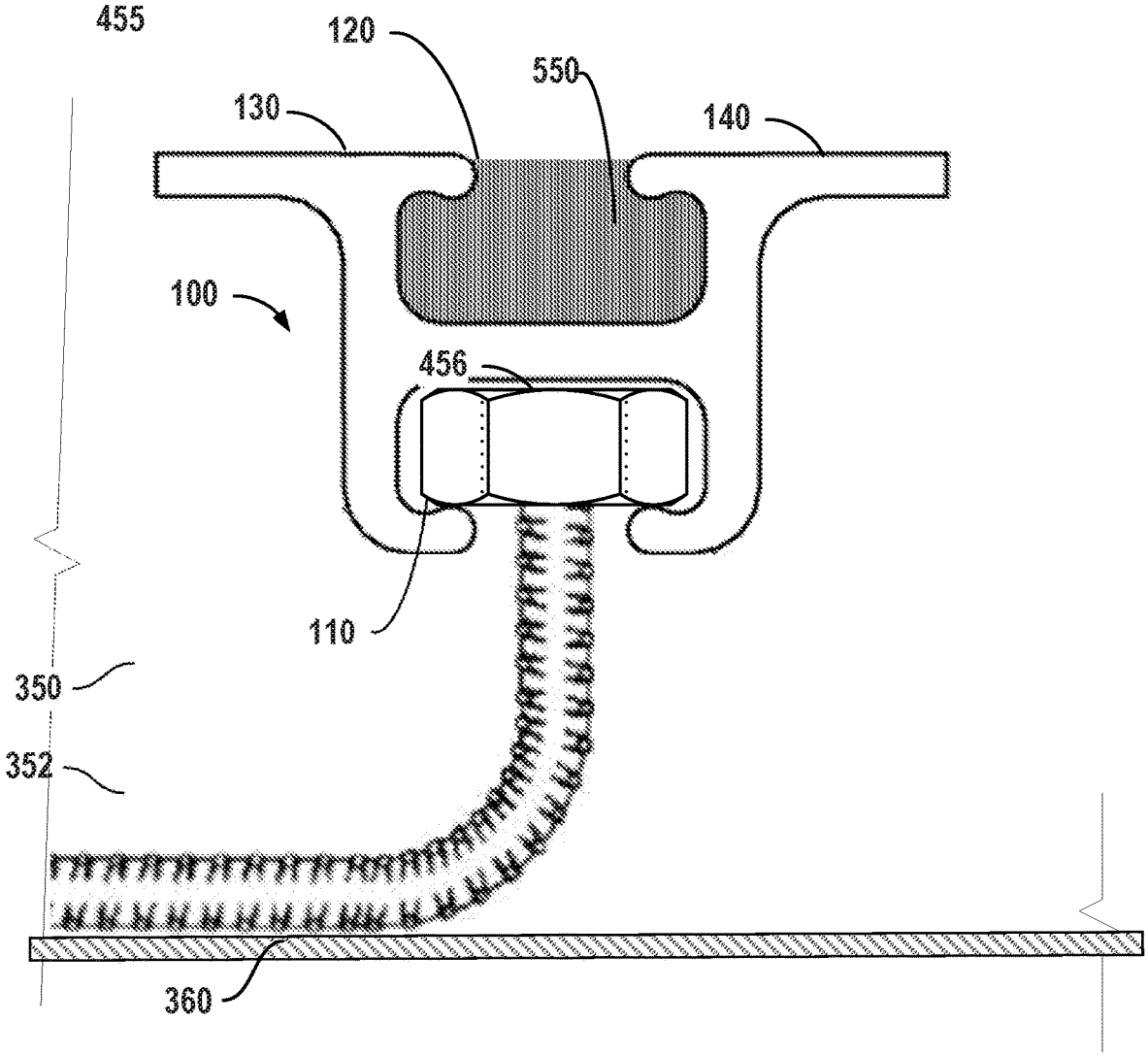
FIG. 6 is an end view of the façade of FIG. 5 with a concrete stop in the inner channel.
Figure 7:
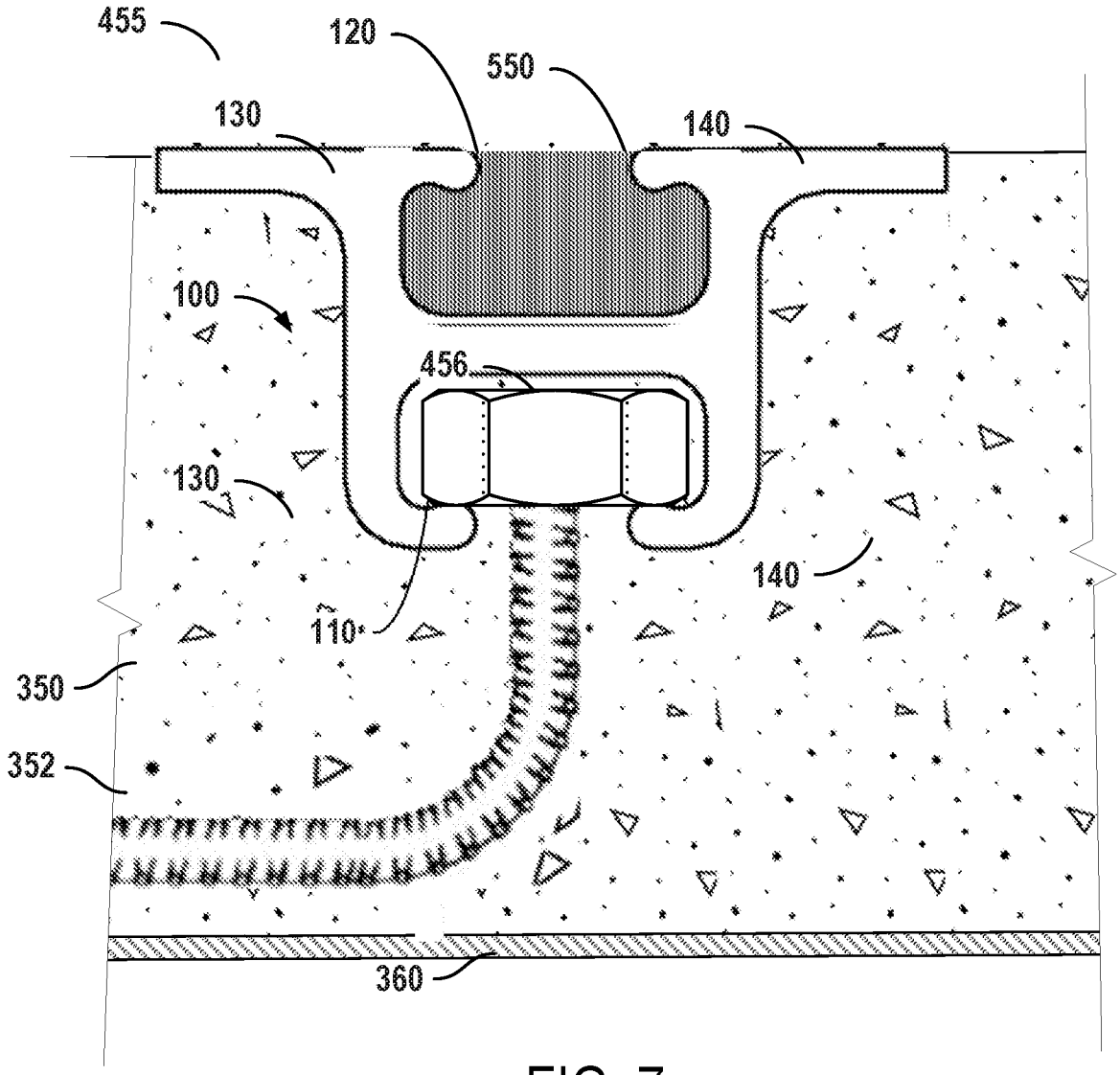
FIG. 7 is an end view of the façade of FIG. 5 after concrete is poured around the façade attachment.
Figure 8:
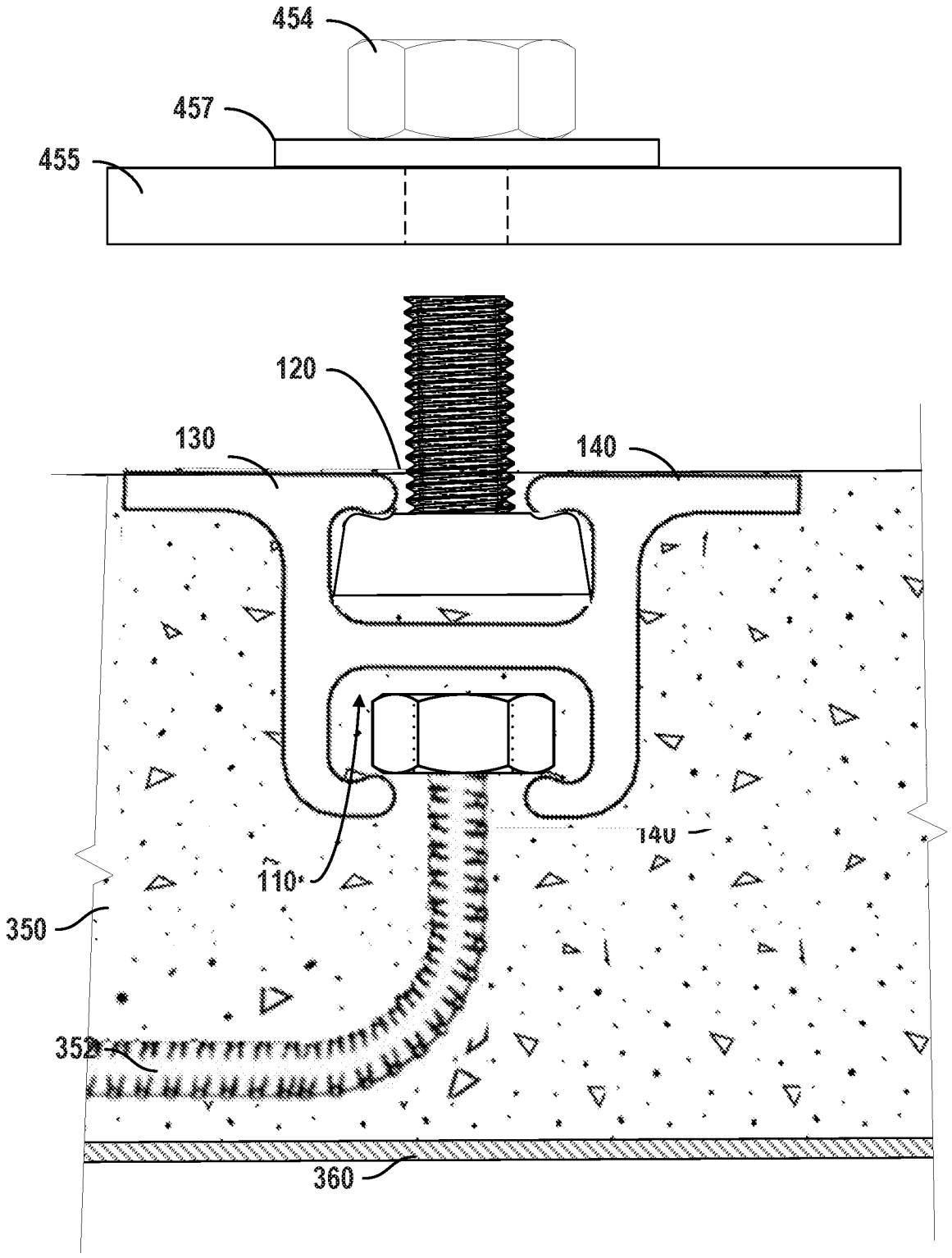
FIG. 8 is an end view of the façade of FIG. 5 illustrating attachment of a slotted plate.

Various embodiments can include a method for installing embed façade attachment system (100) in a reinforced concrete or frame construction floor as illustrated in FIGS. 5-8. The method can include: (a) coupling the embed façade attachment system at the inner side of the embed façade attachment system to a reinforcing structure (e.g. the threaded rebar (352)) laid out for the concrete structure, such that an inner channel (e.g., 110) connects to threaded rebar 352 and an outer channel (e.g. 120) and the inner channel of the embed façade attachment system both open in a vertical direction (FIG. 5); (b) providing a temporary concrete form 360; (c) inserting a concrete stop (550) comprising foam, plastic, or another malleable substance into the outer channel (120) to prevent concrete entering the channel (FIG. 6); (d) pouring mixed concrete in the inner side of the concrete form (e.g., 360) to submerge the embed façade attachment system (FIG. 7); (e) removing the concrete stop (550), leaving the outer channel (120) free of concrete; (f) inserting a fastener such as a T-bold (354) into the outer channel (120) and securing the T-Bolt (FIG. 8); (g) sliding a slotted plate 455 (or other façade attachment adapter) over the shank 420 of the T-bolt; (h) securing the slotted plate to the T-bolt using nut (454) and washer (458); and/or removing the concrete form (e.g., 360), after the concrete is cured.

In other embodiments, the embed façade attachment system (100) shown in FIGS. 4-8 may be rotated 180 degrees so that the rebar is connected to the outer channel (120) and the T-bolt connected to the inner channel (110), with plate 455 secured by the T-bolt in the inner channel. In some embodiments, items (a)-(h) of the above-described method of FIGS. 5-8 can be performed in any suitable order, and one or more items can be omitted or altered. In the aforementioned embodiment, the embed façade attachment system (100) is installed to allow vertical coupling of the façade in a floor or ceiling of a building, and the outer (or inner) channel is exposed to allow vertical coupling of the façade element. On other embodiments, vertical coupling may be provided from an opposing side of the concrete (i.e. the ceiling of a building).

Figure 9:
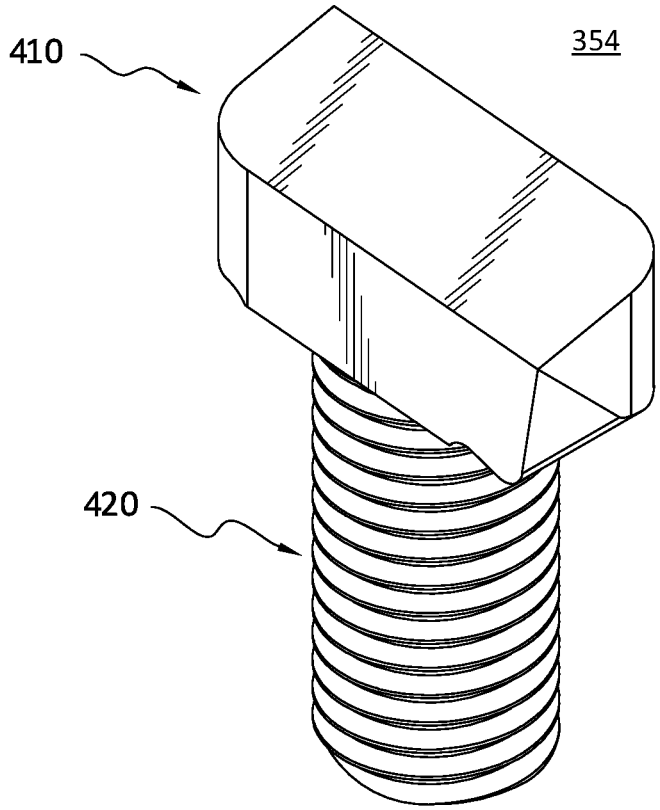
FIG. 9 illustrates a top, side perspective view of a T-bolt, according to an embodiment.
Figure 10:
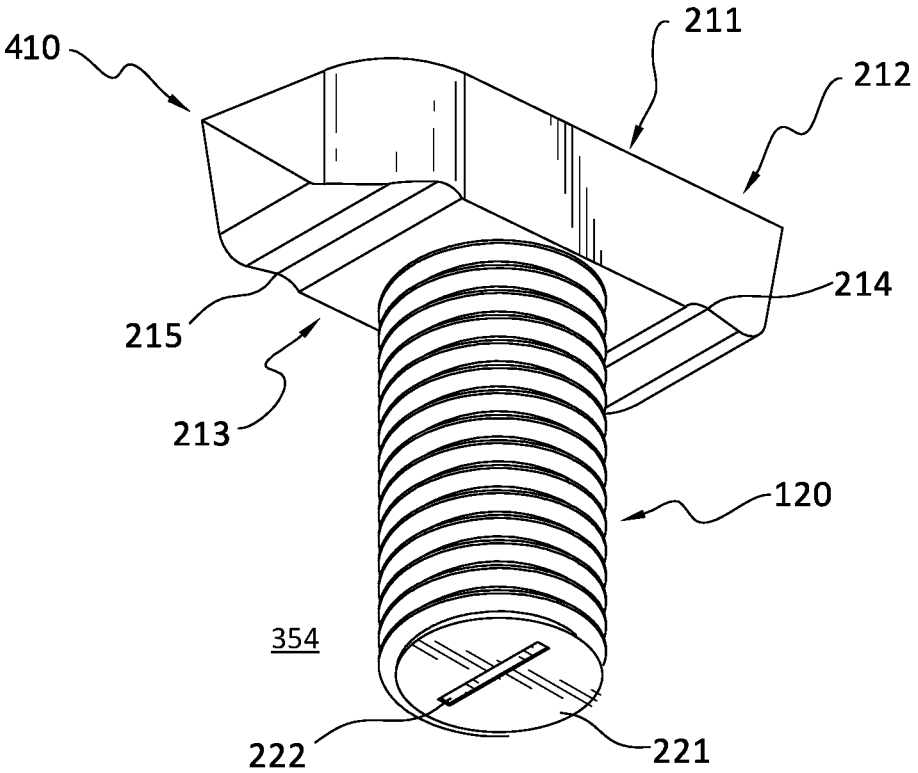
FIG. 10 illustrates a bottom, side perspective view of the T-bolt of FIG. 9.

FIG. 9 illustrates a top, side perspective view of a T-bolt 354. FIG. 10 illustrates a bottom, side perspective view of T-bolt 354. FIG. 11 illustrates a top plan view of T-bolt 354. FIG. 12 illustrates a side elevation view of T-bolt 354. T-bolt 354 is merely exemplary, and embodiments of the T-bolt are not limited to embodiments presented herein. The T-bolt can be employed in many different embodiments or examples not specifically depicted or described herein. In many embodiments, such as shown in FIGS. 5-8, T-bolt 354 can include a head 410 and a shank 420. Head 410 can include a center portion 211 between a first end 212 and a second end 213 that is opposite first end 212. First end 212 can include a locking groove 214, and second end 213 can include a locking groove 215. Locking grooves 214 and 215 can extend parallel to each other across the underside of head 410 at each end (212, 213). Shank 420 can extend from center portion 211 of head 410 to a shank end 221. The extended shape of head 410, from first end 212 to second end 213, together with shank 220, can form a T-shape, as shown in FIG. 8. In some embodiments, an entire length of shank 420 can be threaded. In other embodiments, a first portion of shank 420 proximate to head 410 can be non-threaded, and a second portion of shank 420 proximate to shank end 221 can be threaded. In several embodiments, shank end 221 can include an orientation mark 222. As shown in FIG. 6, orientation mark 222 can be a recessed groove in shank end 221. In other embodiments, orientation mark 222 can be a raised protrusion on shank end 221 or another suitable indicator of the orientation of T-bolt 354. T-bolt 354 can be made of steel or another suitable material.

As shown in FIG. 11, head 410 can include a first side 311 and a second side 312 opposite first side 311. In many embodiments, first side 311 can be parallel to second side 312. First side 311 can extend from a corner 318 at second end 213, across center portion 211, to a first rounded surface 315 at first end 212. Second side 312 can extend from a corner 317 at first end 212, across center portion 211, to a second rounded surface 316 at second end 213. Head 410 also can include a third side 313 and a fourth side 314. Third side 313 can be located at second end 213, and can extend from corner 318 to second rounded surface 316. Fourth side 314 can be located at first end 212, and can extend from corner 317 to first rounded surface 315. In many embodiments, third side 313 can be parallel to fourth side 314, or at least edges of third sides 313 and 314 where sides 313 and 314 meet top of head 410 can be parallel. Head 410 can have a width 336 between first side 311 and second side 312. In many embodiments, width 336 can be approximately the same as the width of shank 420. A length 337 between corner 317 and 318 can be measured orthogonally to width 336. In a number of embodiments, length 337 can be more than twice width 336.

As shown in FIGS. 10 and 11, orientation mark 222 can extend along a reference line 331, which can be parallel to the lines 332 and 333, which indicate a proximal end of locking grooves 214 and 215 (FIG. 10), respectively. In many embodiments, first side 311 can be positioned at an angle 334 with respect to reference line 331. In many embodiments, angle 334 can be greater than 90 degrees, such that first side 311 is not orthogonal to reference line 331. For example, in some embodiments, angle 334 can be approximately 95 degrees. In other embodiments, angle 334 can be between 90 degrees and 110 degrees, for example. In many embodiments, first side 311 can be positioned at an angle 335 with respect to third side 313 at corner 318. In many embodiments, angle 335 can be less than 90 degrees, such that first side 311 and third side 313 are not orthogonal. For example, in some embodiments, angle 335 can be approximately 75 degrees. In other embodiments, angle 335 can be between 60 degrees and 85 degrees, for example. Second side 312 and fourth side 314 can be similarly disposed, such that head 410 has rotational symmetry when rotated 180 degrees around the axis extending through shank 420.

As shown in FIG. 12, head 410 can extend between a head bottom 414 and a head top 415 at center portion 211. At first end 212, when moving outward from center portion 211, locking groove 214 can extend upwards (toward head top 415) from head bottom 414 at line 332 up to a groove base 433, and then can extend back downward from groove base 433 to a groove end 434, which can be at approximately the same plane as head bottom 414. In many embodiments, locking groove 214 can have a depth 432 between groove base 433 and the plane of head bottom 414. In many embodiments, depth 432 can be at least five percent of the thickness of head 410 between head bottom 411 and head top 415. At second end 213, locking groove 215 can be shaped similarly to locking groove 214 when moving outward from center portion 211.

In several embodiments, a first edge 412 at first end 212 extending between corner 317 at head top 415 and groove end 434 can be at an angle 431 with respect to head top 415. In some embodiments, angle 431 can be greater than 90 degrees, such that first edge 412 is not orthogonal to head top 415. For example, in some embodiments, angle 431 can be 354 degrees. In other embodiments, angle 431 can be between 90 and 120 degrees. A second edge 413 at second end 213 can be disposed similarly to first edge 412, such that head 110 has rotational symmetry when rotated 180 degrees around the axis extending through shank 420.

The foregoing is provided for purposes of illustrating, explaining, and describing embodiments of these disclosures. Modifications and adaptations to these embodiments will be apparent to those skilled in the art and may be made without departing from the scope or spirit of these disclosures.

Although embed façade attachments and embed façade attachment systems have been described with reference to specific embodiments, it will be understood by those skilled in the art that various changes may be made without departing from the spirit or scope of the disclosure. It is intended that the scope of the disclosure shall be limited only to the extent required by the appended claims. For example, to one of ordinary skill in the art, it will be readily apparent that any element of FIGS. 1-8 may be modified, and that the foregoing discussion of certain of these embodiments does not necessarily represent a complete description of all possible embodiments. The inner channel (e.g., 110 (FIGS. 1-8)) and outer channel (e.g., 120 (FIGS. 1-8)) can be symmetrical or asymmetrical. The one or more inner fasteners (e.g., T-bolt (354) (FIGS. 9-12)) and the one or more outer fasteners can be similar or different. The couplers (e.g., coupler 356 (FIG. 3)) can be any suitable structures configured to couple the one or more inner fasteners (e.g., the T-bolt (354) (FIG. 9 12)) and/or the one or more outer fasteners to the reinforcing structure (e.g., rebar (352) (FIG. 3-8)) in the reinforced concrete wall (e.g., the concrete wall (350) (FIG. 3)) and/or the attachment component of a façade panel. Accordingly, the disclosure of embodiments is intended to be illustrative of the scope of the disclosure and is not intended to be limiting.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more electrical elements may be electrically coupled together, but not be mechanically or otherwise coupled together. Coupling may be for any length of time, e.g., permanent or semi-permanent or only for an instant. "Electrical coupling" and the like should be broadly understood and include electrical coupling of all types. The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

As defined herein, "approximately" can, in some embodiments, mean within plus or minus ten percent of the stated value. In other embodiments, "approximately" can mean within plus or minus five percent of the stated value. In further embodiments, "approximately" can mean within plus or minus three percent of the stated value. In yet other embodiments, "approximately" can mean within plus or minus one percent of the stated value.

What is claimed is:

1. An embed façade attachment system, comprising:

an inner channel configured to receive one or more fasteners between an inner upper retaining flange and an inner lower retaining flange defining a first opening, each of the inner upper and lower retaining flange having a flange thickness and a rounded end having a greater thickness than the flange thickness;

an outer channel integrally formed with and sharing an inner wall with the inner channel, the outer channel defined between an outer upper retaining flange extending to an upper outward flange, and an outer lower retaining flange extending to a lower outward flange defining an second opening opposed to the first opening and configured to receive one or more fasteners, each of the outer upper and lower retaining flange having a flange thickness and a rounded end having a greater thickness than the flange thickness;

one of the inner channel and the outer channel coupled to a concrete reinforcement element;

another of the inner channel and the outer channel is removably coupled to a façade element by the one or more fasteners; and the façade attachment system embedded in concrete with at least the inner channel or the outer channel exposed to a surface of the concrete to allow coupling of the façade element.

2. The embed façade attachment system of claim 1 wherein the inner channel is coupled to the concrete reinforcement element and the outer channel is removably coupled to the façade element.

3. The embed façade attachment system of claim 1 wherein the outer channel is coupled to the concrete reinforcement element and the inner channel is removably coupled to the façade element.

4. The embed façade attachment system of claim 1 wherein the one or more fasteners are nuts.

5. The embed façade attachment system of claim 1 wherein the one or more fasteners are T-bolts.

6. The embed façade attachment system of claim 1 wherein the upper outward flange, upper retaining flange, lower outward flange, and lower retaining flange are substantially coplanar.

7. The embed façade attachment system of claim 1 the concrete comprises a portion of a building, the surface of the concrete faces an exterior of the building, and wherein the outer channel is exposed to the exterior to allow horizontal coupling of the façade element.

8. The embed façade attachment system of claim 1 the concrete comprises a portion of a building, the surface of the concrete comprises a floor the building, and wherein the inner channel is exposed to allow vertical coupling of the façade element.

9. A method for installing an embed façade attachment system in a reinforced concrete structure, comprising:

coupling an inner side of the embed façade attachment system to a reinforcing structure in the concrete structure, the inner side comprising an inner channel configured to receive one or more fasteners of the reinforcing structure between an inner upper retaining flange and an inner lower retaining flange defining a first opening, each of the inner upper and lower retaining flange having a flange thickness and a rounded end having a greater thickness than the flange thickness;

coupling a temporary concrete form to the embed façade attachment system at an outer side, the outer side including an outer channel sharing an inner wall with the inner channel, the outer channel defined between an outer upper retaining flange extending to an upper outward flange, and an outer lower retaining flange extending to a lower outward flange defining an second opening opposed to the first opening and configured to receive one or more fasteners, the temporary concrete form attached to one of the upper outward flange or lower outward flange;

pouring mixed concrete in the inner side of the concrete form to submerge the embed façade attachment system, except the outer channel; and removing the concrete form after the concrete is cured, to expose the outer channel of the embed façade attachment system; and coupling a façade attachment using a fastener in the outer channel.

10. The method of claim 9 wherein the reinforcing structure is rebar and coupling includes connecting outer channel to threaded rebar such that an inner channel and an outer channel of the embed façade attachment system both open in a horizontal direction.

11. The method of claim 9 wherein the coupling the inner side comprises attaching the inner side to the reinforcing structure using a coupler and a T-bolt in an inner channel of the system.

12. The method of claim 9 wherein outer channel is exposed to an exterior of a portion of a building, the inner side and the reinforcing structure are on an interior of the building, whereby the outer channel is placed to allow horizontal coupling of a façade element.

13. A method for installing an embed façade attachment system in a reinforced concrete structure, comprising:

coupling the embed façade attachment system at an outer side of the embed façade attachment system to a reinforcing structure laid out for the concrete structure, the embed façade attachment system comprising an first channel configured to receive one or more fasteners between a first upper retaining flange and a first lower retaining flange defining a first opening, each of the first upper and lower retaining flange having a flange thickness and a rounded end having a greater thickness than the flange thickness;

an second channel integrally formed with the first channel and sharing an inner wall with the first channel, the second channel defined between a second upper retaining flange extending to an upper outward flange, and a second lower retaining flange extending to a lower outward flange defining an second opening opposed to the first opening and configured to receive one or more fasteners, each of the second upper and lower retaining flange having a flange thickness and a rounded end having a greater thickness than the flange thickness;

inserting a malleable concrete stop into the first channel;

pouring mixed concrete around the embed façade attachment system to submerge the embed façade attachment system;

removing the concrete stop leaving the first channel substantially free of concrete;

inserting a fastener into the first channel and securing a façade attachment plate to the second channel using the fastener.

14. The method of claim 13 wherein the reinforcing structure is rebar and coupling includes connecting first channel to threaded rebar such that the first channel and an the second channel of the embed façade attachment system both open in a vertical direction.

15. The method of claim 13 wherein the malleable concrete stop comprises foam, plastic, or another malleable substance.

16. The method of claim 13 wherein the fastener is a T-bolt.

17. The method of claim 16 wherein the method includes securing the façade attachment plate to the T-bolt using nut (454) and washer plate (457).

* * * * *